US005761886A

United States Patent [19]

Parkhideh

[11] Patent Number: 5,761,886

[45] Date of Patent: Jun. 9, 1998

[54] APPARATUS AND METHOD FOR MANUFACTURING ENCAPSULATED PRODUCTS

[76] Inventor: Shahrooz Parkhideh, 3 Garden Ave., Stony Brook, N.Y. 11790

[21] Appl. No.: 599,173

[22] Filed: Feb. 9, 1996

[51] Int. Cl.[6] ..... B65B 47/10; B65B 9/04

[52] U.S. Cl. ..... 53/454; 53/140; 53/560; 53/51

[58] Field of Search ..... 53/454, 453, 467, 53/473, 51, 55, 140, 560, 559, 503, 268

[56] References Cited

U.S. PATENT DOCUMENTS

| | | | |
|---|---|---|---|
| 2,288,327 | 6/1942 | Scherer | 53/560 |
| 2,624,164 | 1/1953 | Donofrio | 53/560 X |
| 2,663,129 | 12/1953 | Donofrio | 53/560 |
| 2,697,317 | 12/1954 | Stirn et al. | 56/560 |
| 3,092,942 | 6/1963 | Chasman | 53/560 |
| 3,465,496 | 9/1969 | Hansen | 53/560 |
| 3,916,598 | 11/1975 | Adams et al. | 53/55 |
| 4,506,488 | 3/1985 | Matt et al. | 53/55 |
| 4,567,714 | 2/1986 | Chasman | 53/454 X |
| 4,817,367 | 4/1989 | Ishikawa et al. | 53/454 |
| 5,388,387 | 2/1995 | McElvy | 53/51 X |

*Primary Examiner*—Horace M. Culver
*Attorney, Agent, or Firm*—Galgano & Burke

[57] ABSTRACT

Methods and apparatus for forming capsules provides novel processing flexibility including dies which are independently movable, even during capsule formation, the ability to vary the speed of the dies even during the formation of a single capsule, independently controlled drums and dies. Advantageously, at least one and most preferably a plurality of independently actuatable pumps are provided for greater control over the dispensing of fill material. For example, the fill rate can be varied during the filling of a single capsule. Preferred embodiments provide electric/electronic signals to actuate the f fill material dispensers, provide for the independent control of rotatable drums, rotatable dies and the dispensers.

56 Claims, 11 Drawing Sheets

FIG. 8
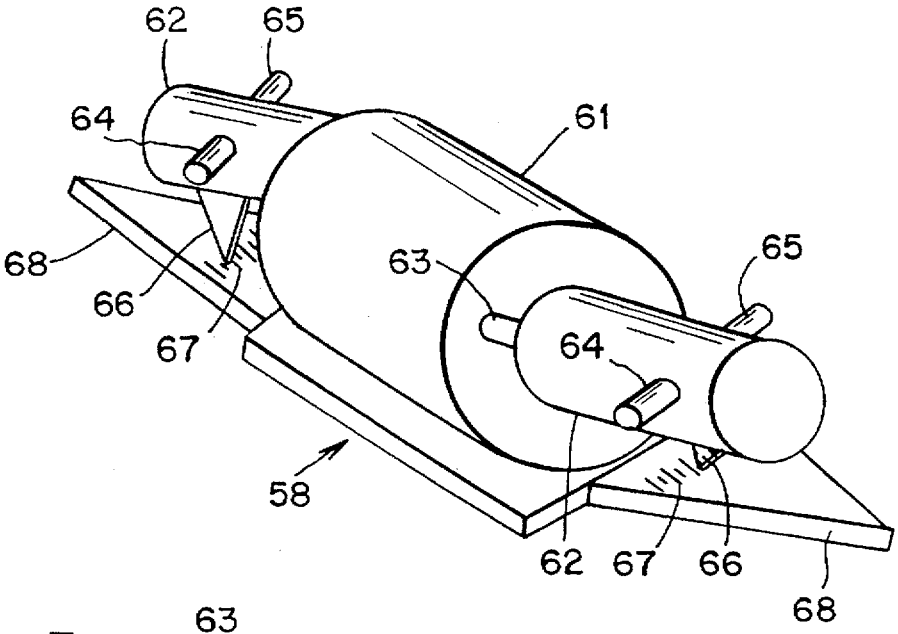
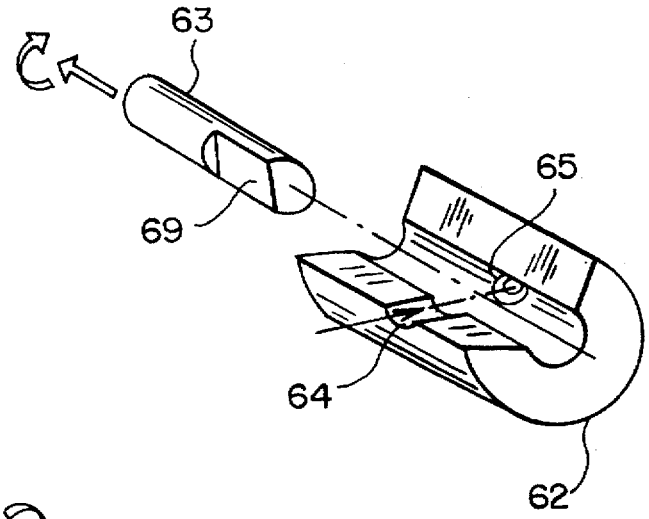
FIG. 9
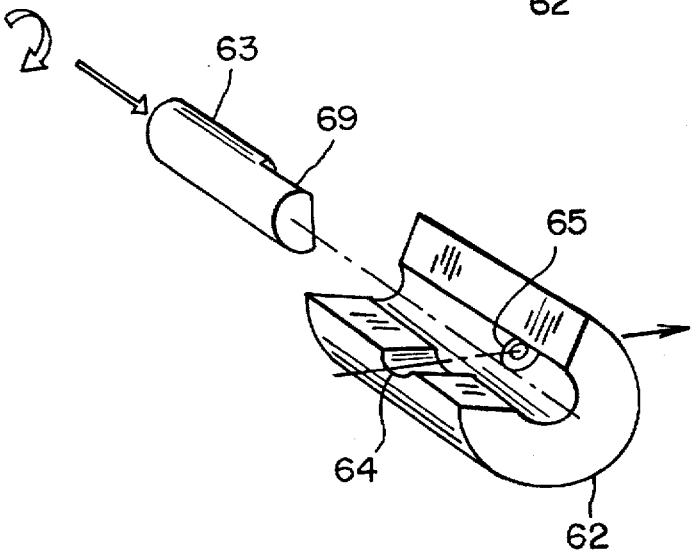
FIG. 10

APPARATUS AND METHOD FOR MANUFACTURING ENCAPSULATED PRODUCTS

This invention is related to an improved apparatus for producing ingestible encapsulated products such as soft gelatin capsules filled with liquid, suspensions, solids, semi-solids, powders, medicines, nutrients, or other materials.

BACKGROUND

U.S. Pat. No. 1,970,396 to Scherer describes an early method and machine for producing soft gelatin capsules in an automated process. The process involves the formation of two gelatin sheets by cooling liquefied gelatin on two separate drums, then lubricating and guiding the two sheets into communication with each other over two co-acting dies while simultaneously dispensing the proper amount of medicine or other fill material between the sheets in registration with half cavities in the outer surface of the dies. The machine was driven by a single motor, belt, and pulleys. Various elements of the machine, such as drums, dies, and the medicine pump were driven and synchronized by a variety of interconnected shafts and gears. In general, the currently used machines still use a similar general process and technology.

Over the years, various techniques have been used to extend the process to the encapsulation of medicines, nutrients, or other materials including powder, granular, and tablet form. Some representative patents are U.S. Pat. Nos. 2,775,080 (Stirn et al), 4,567,714 (Chasman), 5,074,102 (Simpson et al), and 5,146,730 (Sadak et al).

U.S. Pat. No. 4,817,367 to Ishikawa et al. introduced some improvements to the basic machine to aid in the setup, operation and quality of product produced. In the Ishikawa machine, a liquid coolant is circulated inside the casting drums to cool the gelatin in sheet formation process. Furthermore, numerical indicators were added to the machine to aid the operator during setup and operation. Also, the driving mechanism for the gelatin capsule recovery mechanism is independent of other driving mechanisms provided in that apparatus.

These previously utilized machines had many structural and operational shortcomings. Many of the shortcomings related to the set up of the machine. For example, the die-to-die timing which is important to protecting the equipment and providing a quality product involves aligning the two counter-rotating dies that are used to produce capsules. The previously utilized machines involved a manual process requiring the loosening of three bolts, turning another bolt on the back of the machine to rotate one die until the two dies were timed. This alignment process would typically take about fifteen minutes and can only be accomplished when the machine is turned off. There is therefore a need to provide an apparatus for forming gelatin capsules having two dies which are easier to align than the previously known apparatus.

Another shortcoming of the previously utilized apparatus described above is the difficulty in setting the timing between the dies and the wedge which provides fill material to the sheets during the capsule formation. This timing is important to the formation of quality seals between opposing gelatin layers, as well as to maintaining a consistent and accurate fill weight and reducing waste of fill material. If this timing is not correct, there is a high likelihood of obtaining capsules which leak and/or with inconsistent fill weights. FIG. 1B roughly illustrates the positional relationship between a wedge 200 which rests on the opposing gelatin sheets 210 and 211 between the upper regions of opposing dies 220, 222. The wedge 200 comprises at least one discharge port, extending laterally toward the gelatin sheets. During operation, fill material is forced out the discharge port(s) 205 thereby forcing the sheets into the opposing die cavities 221, 223. Those skilled in the art appreciate that it is important to maintain proper timing between the discharge port(s), the pump which forces the fill material out of the ports and the die cavities which receive the fill material. In the previously utilized apparatus, timing lines T were provided on both the wedge 200 and each of the dies 220, 222. Adjusting the die to wedge to pump timing required jogging the drive motor until the timing line T of the die cavities was lines up with the timing line T of the wedge. The pump assembly was then raised, timing gear was removed or disengaged from the idle gear and a crescent wrench was used to turn the pump until it was at the injection position prior to re-engagement of the idler gear. Since the idler gear was positioned on a square shaft, it was sometimes necessary to advance the gear a portion of one gear tooth to accommodate re-engagement. The machine was then started and the timing checked by starting the gelatin, setting the gelatin ribbon thickness, heating the wedge and making capsules. If the timing was not precise, it was necessary to repeat the entire process. Since the timing adjustments were accomplished while the machine was off, each timing adjustment would typically take about twenty minutes for each iteration if the capsule fill weight was unstable or if the seam quality of the capsules was poor, the entire timing process would have to be repeated. Due to multiple iterations, it is possible that the entire timing process could take hours, for example, eight hours. Furthermore, such adjustments could result in a significant material cost since fill material often averages about $40.00 per kilo while in extreme cases, fill material can cost thousands of dollars per kilo.

Another related disadvantage of the previously utilized apparatus was the use of a plunger-type pump whose operation was linked to the other moving elements including the gelatin drums and the dies. The duration of an injection of fill material was a function of the pump plunger diameter and the volume of fill material being injected (determined by the capsule fill weight and the material density). For given applications, the plunger diameter of the previously utilized apparatus was fixed, therefore the operator had no control over the injection duration. It would therefore be desirable to provide an apparatus comprising greater flexibility.

The dispensing of fill material by such previously utilized apparatus typically comprised a fixed number of plungers which were linked and driven by a common camshaft such that half of the plungers were pumping while the other half were receiving fill material. Such pumping arrangements are expensive, very complex, and more labor intensive requiring significant time to clean or replace broken parts. Many of the pumps previously used were formed with non-sanitary material which was very difficult to clean. As described in further detail below, in the previously utilized apparatus, it was critical that the pump and pump case timing be adjusted correctly; a process which could take fifteen to twenty minutes. It would therefore be desirable to eliminate this time consuming timing step.

Another disadvantage of the previously utilized apparatus was the inability to dynamically vary the rotational speed of the dies during capsule formation. Those skilled in the art will appreciate that capsules of any given formation will tend to have regions along their seams where the likelihood of seam failure is significantly higher. The previously utilized apparatus left no manner of addressing these regions of seam weakness, short of slowing down the entire production rate. It would therefore be desirable to provide a method and apparatus for the formation of gelatin capsules which provides flexibility to address weaknesses inherent in specific capsule shapes.

A still further shortcoming with the previously utilized apparatus was the manner of monitoring the die-to-die pressure. Those skilled in the art will appreciate that if the pressure in the nip between two dies is too high, the life of the dies can be severely reduced. On the other hand, if the pressure between the dies is too low, the capsules will not have proper seals. Therefore, there is a need for better die torque monitoring capability.

SUMMARY OF INVENTION

The present invention is directed to apparatus and methods for manufacturing encapsulated products, such as ingestible capsules comprising a fill material such as medicine, nutrients, and the like, encapsulated within a gelatin. One preferred illustrated apparatus of the present invention comprises a plurality of independently movable dies which receive formed sheets which are fed between the dies with a filler substance. Cavities in the dies encapsulate the filler substance between the formed sheet material into capsules.

Another preferred apparatus of the present invention comprises a plurality of dies wherein the speed of those dies can be varied during the formation of a single capsule. This embodiment is particularly useful in maintaining process efficiency by keeping the operating speed at a maximum while allowing speed reductions at problematic cavity regions in order to increase the sealed time at those regions. The dies are most preferably relatively independently movable while the dies are rotating. According to another preferred aspect of the present invention, each of the dies is driven by an independently controlled die motor.

Another preferred embodiment of the present invention comprises an apparatus for forming capsules wherein a flowable mass is formed into at least two sheets by contacting the flowable material with a drum. According to this preferred embodiment, each of the drums is driven by an independently controlled drum motor.

According to another preferred aspect of the present invention, at least one and preferably a plurality of fill material dispenser pumps are independently controlled by electric/electronic signals. Another preferred aspect of the present invention comprises an apparatus for forming capsules having an operator interface terminal which independently controls two rotatable drums for forming two sheets from a flowable mass, two rotatable dies and at least one independently operable pump.

Another preferred aspect of the present invention comprises an apparatus for forming capsules wherein at least two cavities of a single die have different configurations.

The present invention also comprises novel methods for forming capsules comprising the steps of: providing means for supplying at least one flowable mass which is formable into a sheet configuration; forming two sheets from said flowable mass; providing means for forming filled capsules with said sheets comprising a plurality of independently movable dies cooperatively forming an encapsule region which receives said sheets, at least one of said dies comprising a plurality of spaced cavities; transferring said sheets from said sheet forming means to said capsule forming means; adjusting the relative positioning of said movable dies while said sheets are moving between said dies; and dispensing a fill substance to at least one portion of one of said sheets prior to said portion exiting said encapsulation region where said filler substance is encapsulated between portions of said sheets.

Another method of the present invention comprises the step of varying the speed of the dies during the formation of a single capsule. Another method comprises the step of independently driving each drum used in forming the sheets, while another preferred aspect comprises the step of independently controlling each of the dies with a die motor.

Another preferred method of the present invention comprises the step of supplying electric/electronic signals to at least one, and most preferably to a plurality of pumps to control the timing and rate of the dispensing of fill material. For example, one preferred method comprises varying the rate of dispensing fill material during the encapsulation of a single capsule. Other preferred steps comprise independently controlling a plurality of rotatable drums, a plurality of rotatable dies and at least one dispenser of fill material.

The present invention is designed to reduce the manufacturing time and cost of the machine by minimizing the use of custom parts and subassemblies and substituting available OEM components. Through electronic control, setup time is greatly reduced, runtime adjustments are enabled, and new manufacturing capabilities are added thereby improving productivity and output quality. The mechanical design of the machine is greatly simplified, precision is increased, while wear and maintenance are substantially reduced.

Various embodiments of the present invention are designed to eliminate certain mechanical components of widely used encapsulation machines such as non-sanitary pump components, pump housing, pump lifting handle, pump lifting shafts, change gear subsystem, main drive motor, drive pulleys and belt, several drive gears and intermediate shafts, distribution plate on wedge, shut-off valve, medicine return hose, die alignment adjusting gear, grease/oil in column and die housing, and oil in pump housing.

Various embodiments also advantageously eliminate machine lubricants, a potential source of contamination. As part of this change, the following sub-components can be eliminated: grease/oil in the column and die housing, grease/oil seals around the column and die housing, grease/oil sight glass, grease/oil dip stick, grease/oil drain plugs on column and die housings.

The present invention is also designed to enhance precision through the use of independent electrical drives and thereby the significant reduction of mechanical backlash and wear problems, to further reduce contamination by elimination of pump lubricants and non-sanitary metal to metal contact within pump elements.

The various preferred embodiments also improve the dispensing of fill materials through the use of separate pump/drive subassemblies for each injection site on the wedge. Preferred pumps are constructed of sanitary material and to respond to precise electric/electronic start signal; dispensing frequency and duration are infinitely variable and all run-time variables are adjustable.

The present invention is also designed to improve capsule fill weight variation from as high as ±5% for the prior art machine compared to less than ±1% using this invention. The medicine path is streamlined to further reduce exposure to contamination. The path from the source is simply a supply line to the pump, and a delivery line from the pump to the wedge. Eliminated are the shut-off valve, distribution plate, and medicine return hose.

Other advantages include the reduction of setup time and provision for complete run time adjustability, operational flexibility through the use of separate drives for different subsystems utilizing electric/electronic control, continuous diagnostic monitoring with alarm capability, reduction and monitoring of power consumption, reduction of maintenance requirements through the elimination of many interconnected mechanical links, improvements in production yield reducing costs and wastes, as well as providing automatic documentation of production.

BRIEF DESCRIPTION OF THE DRAWINGS

FIG. 8 is a perspective view of a pump useful with the present invention.

FIG. 9 is an exploded perspective view with sections removed of a portion of a pump useful in the present invention in the intake phase.

FIG. 10 is an exploded perspective with sections removed of a portion of a pump useful in the present invention in the discharge phase.

DETAILED DESCRIPTION

Figure 1:
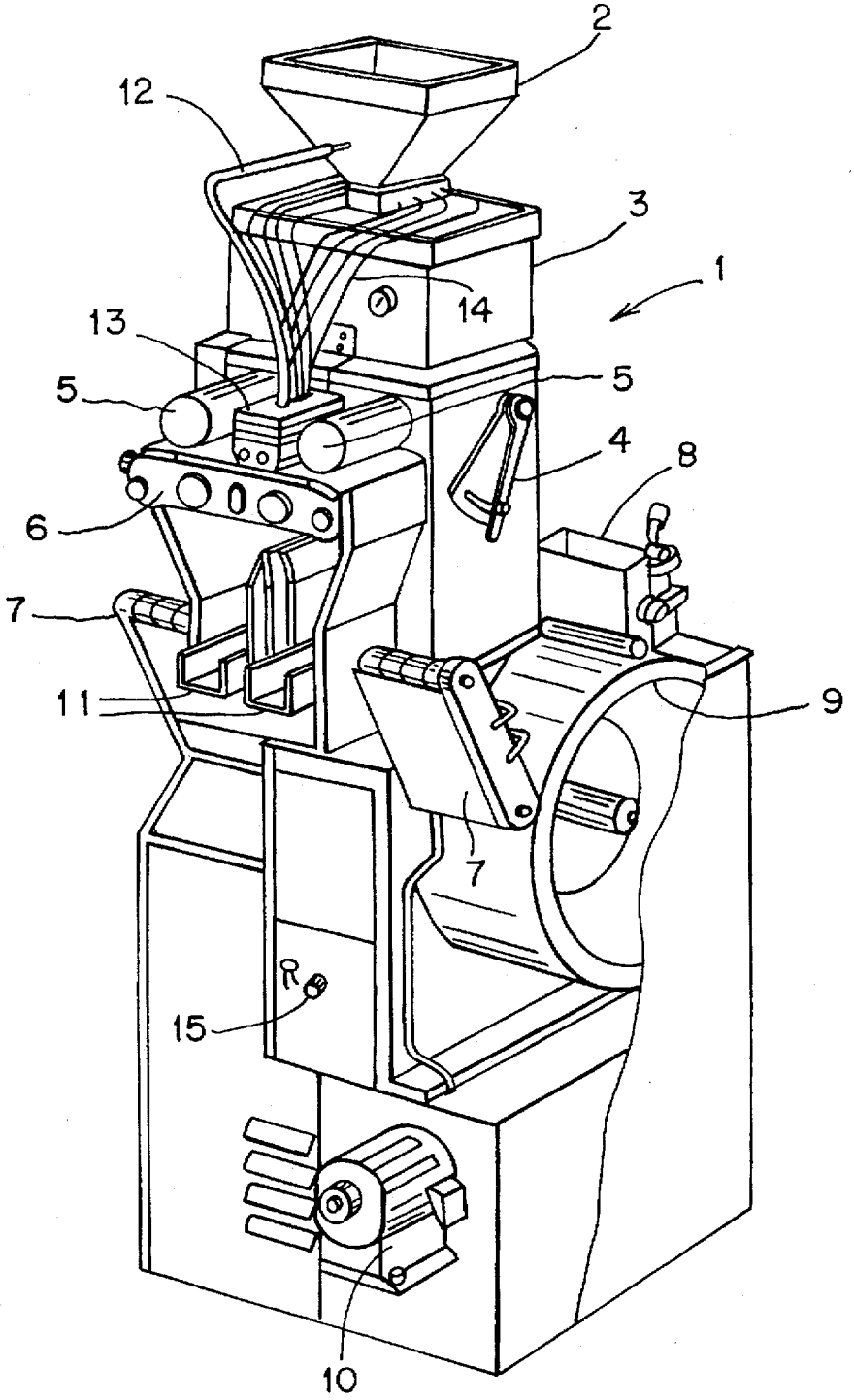
FIG. 1 (Prior Art)
FIG. 1 is a perspective view of one prior art machine, partially cut away.
Figure 1B:
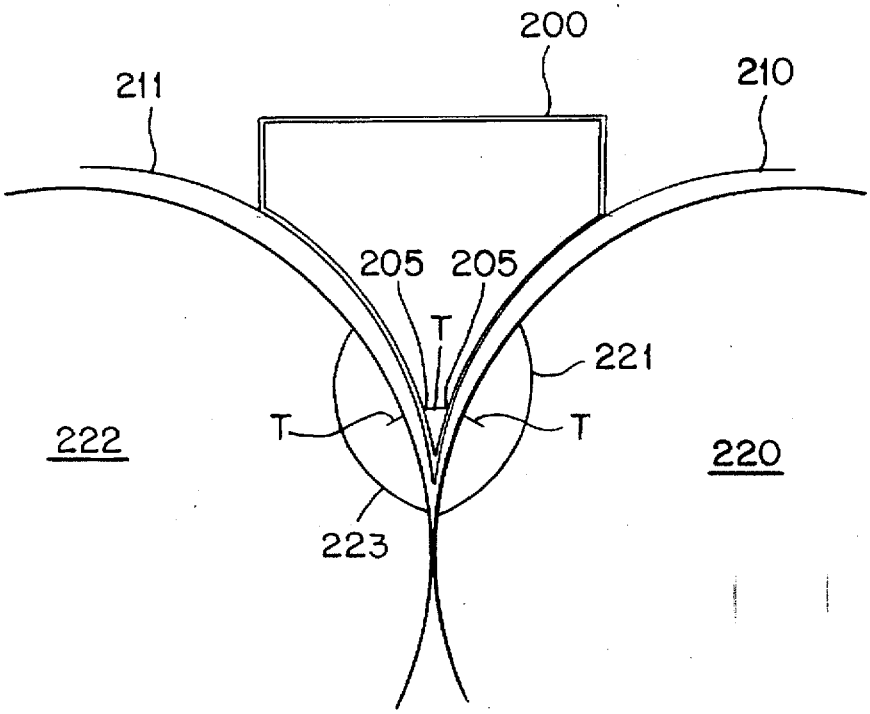
FIG. 1B ( Prior Art )
FIG. 1(B) is a view of a prior art wedge, die arrangement.

FIG. 1 shows a front isometric of a typical prior art machine 1. The motor 10 that operates the machine is shown in the cut away view of the base. The casting drum 9 of the right side is shown under the cut away portion of the skin. The fill hopper 2 is shown above the pump and pump housing 3. Item 4 is the pump lifting handle. The gelatin ribbon starts out as a liquid in spreader box 8 which maintains gelatin's liquid state using heat. The drum's 9 rotation results in formation of a continuous sheet of gelatin. A cooling and/or partial dehydrating media transforms the liquid gelatin into a flexible gelatin ribbon which is threaded through oil roller assembly 7. In this machine, the ribbon makes a twist to enable it to be passed over ribbon roller 5 and then to wedge assembly 13. Both ribbons are formed in the same manner using identical assemblies on either side of the machine (some not shown). The gelatin sheet formed on one drum provides the shell material for one side of the capsule.

Figure 2:
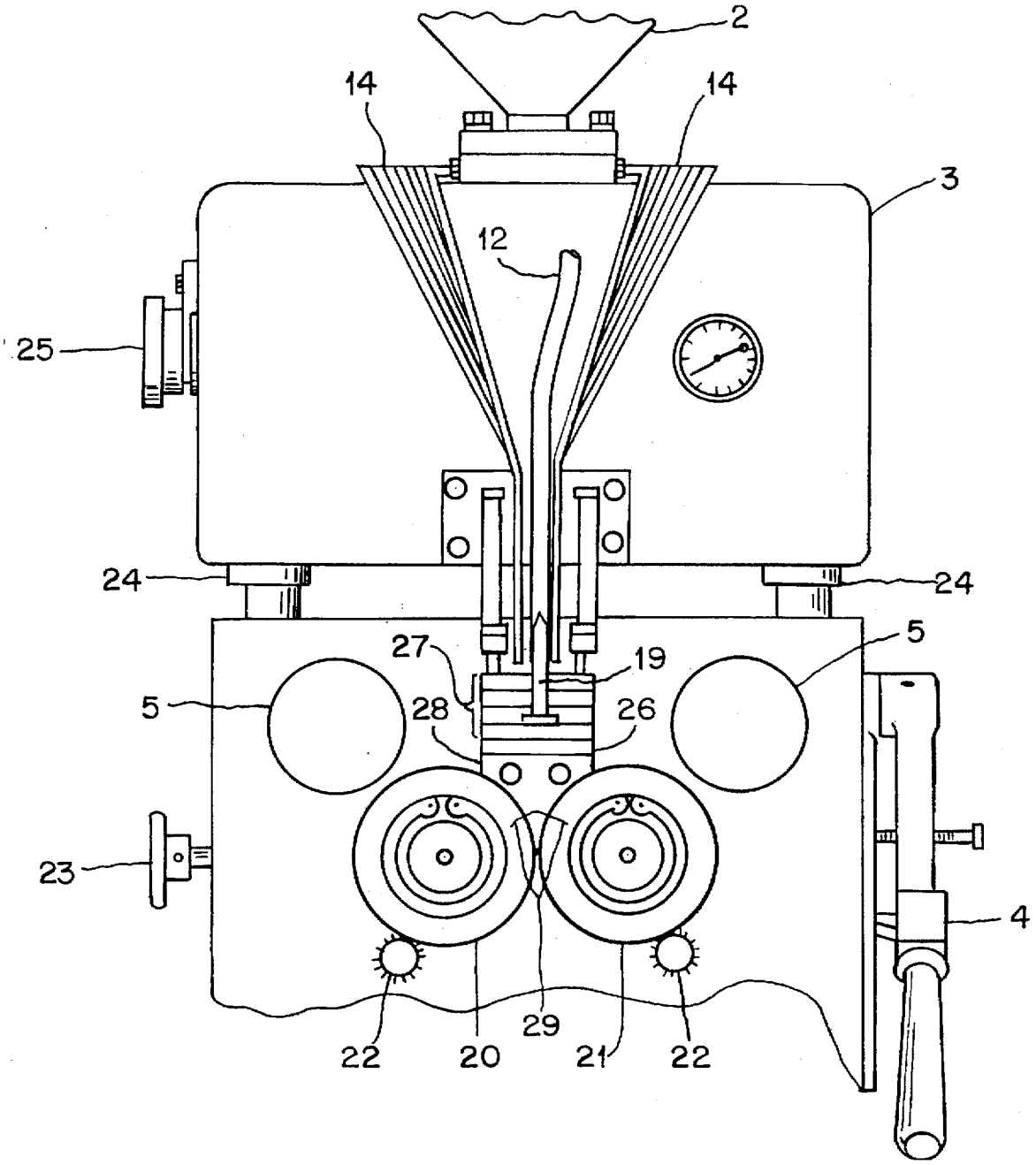
FIG. 2 (Prior Art)
FIG. 2 is a partial front view of the machine shown in FIG. 1.

FIG. 2 is a close-up of a prior art machine. The dies are housed behind the yoke assembly 6 which is removed in FIG. 2 to reveal left die 20 and right die 21. The gelatin sheets are further threaded over the co-acting dies 20 and 21 into communication with each other. Note timing marks 29 lined up with a mark on wedge 28. A pressure adjusting mechanism 23 is used to adjust the pressure between the die rollers. Pressure is applied to die 20 to force it against die 21. This force, in conjunction with heat from the wedge assembly, causes the two sheets of the gelatin to be sealed together and cut along the cavities on the dies to produce a semi-formed empty capsule. In a simultaneous action, pump assembly 3 measures and dispenses the fill material through the tubes 14, shut-off valve 27 having a shut-off handle 19, distribution plate 26, and wedge 28 into the semi-formed empty capsule. The rotation of the dies continues the sealing and cutting process to form a capsule. The output chutes 11 shown in FIG. 1 receive the completed capsules. A sight glass 15 is used to monitor the lubricating oil for the mechanical components of the machine. During the set-up and other phases, medicine is returned to the medicine fill hopper 2 via medicine return hose 12.

Stripper rollers 22 remove any capsules which may be stuck inside the die cavities. A pressure adjusting mechanism 23 is used to adjust the pressure between the die rollers. Since the dies of the prior art apparatus are locked together through gears, die to die alignment is accomplished, only when the machine is not operating. A pump adjusting knob 25 is used during setup to adjust capsule fill weight. Pump lifting shafts 24 work in conjunction with lifting handle 4 to lift or lower the pump and pump housing 3 during setup or removal steps. Distribution plate 26 is used to transfer and distribute fill material from shut-off valve 27 to various locations on the wedge 28. In certain instances, distribution plate 26 is used to distribute fill material from a single tube to multiple injection sites of wedge 28. This practice has a potential disadvantage of delivering unequal amounts of medicine at final injection sites. For example, if the pump has twelve plungers but the die has more than twelve columns of cavities, the distribution plate would be designed to feed two injection sites from each pump/plunger tube. A shut-off valve 27 is shown above the distribution plate 26. Shut-off valve 27 is used to select the direction of the fill material's flow. In the old machine, the dies 20 and 21 and pump assembly 3 are operated by the same motor, therefore, it was necessary to re-route the fill material to the fill hopper 2 during set-up and any other time that the dies are turning but no capsule is being produced. Shut-off valve 27 is the re-routing device. When the shut-off valve 27 is in the closed position, fill material is returned to the fill hopper 2 via the return hose 12 (illustrated in part in FIG. 2). In addition, since, all the pump plungers and plunger displacements are identical and moving simultaneously, all capsules being produced are limited to having an identical fill weight. Furthermore, the timing positions on the die are limited to specific relative positions dictated by the pump movement.

Figure 3:
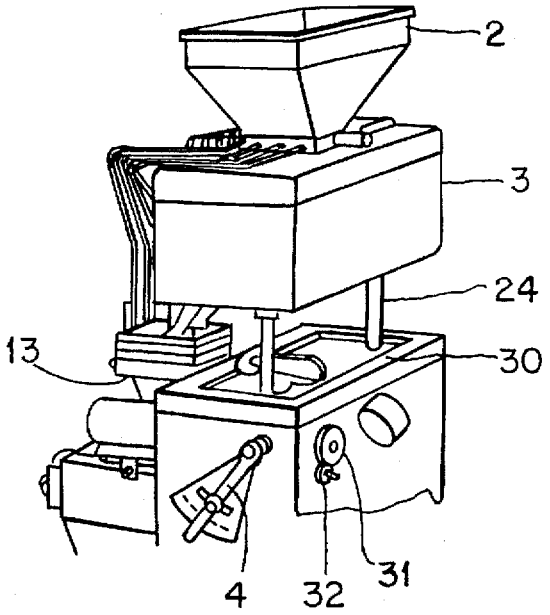
FIG. 3 (Prior Art)
FIG. 3 is a rear, perspective view of a prior art machine.
Figure 4:
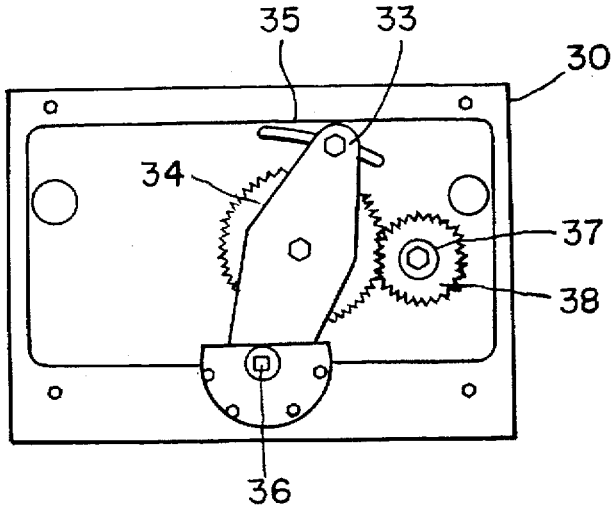
FIG. 4 (Prior Art)
FIG. 4 is an illustration of a gear change plate of the prior art.
Figure 5:
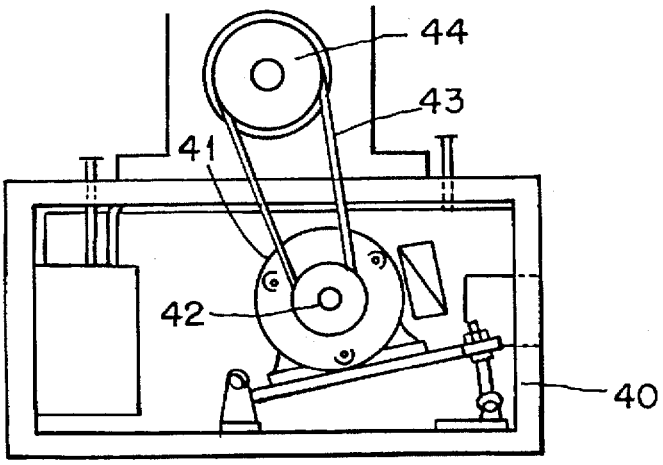
FIG. 5 (Prior Art)
FIG. 5 is a lower rear view of a prior art machine.

FIG. 3 shows the pump and pump housing 3 in its raised position from the rear to reveal the location of the change gear plate assembly 30. The die alignment gear 31 and adjusting key 32 which are used for die to die alignment are shown on the back of the machine. FIG. 4 shows the change gear plate assembly for achieving proper power transfer and alignment for the pump. Since the pump receives its power from the same motor that runs the dies, the pump dispensing frequency selection for a particular product must be made by removing retaining nut 37 and installing the proper change gear 38. That operation must be preceded by loosening nut 35 so that plate 33 can be move counterclockwise to disengage idler gear 34 from change gear 38. Pump drive square 36 receives a long shaft which drives the pump housing and in turn the pump. This entire geared subassembly is eliminated by the present invention. FIG. 5 shows the drive motor 41, motor pulley 42, belt 43 and machine drive pulley 44 which constitute the power source for the machine. These parts are also eliminated by the present invention.

Figure 6:
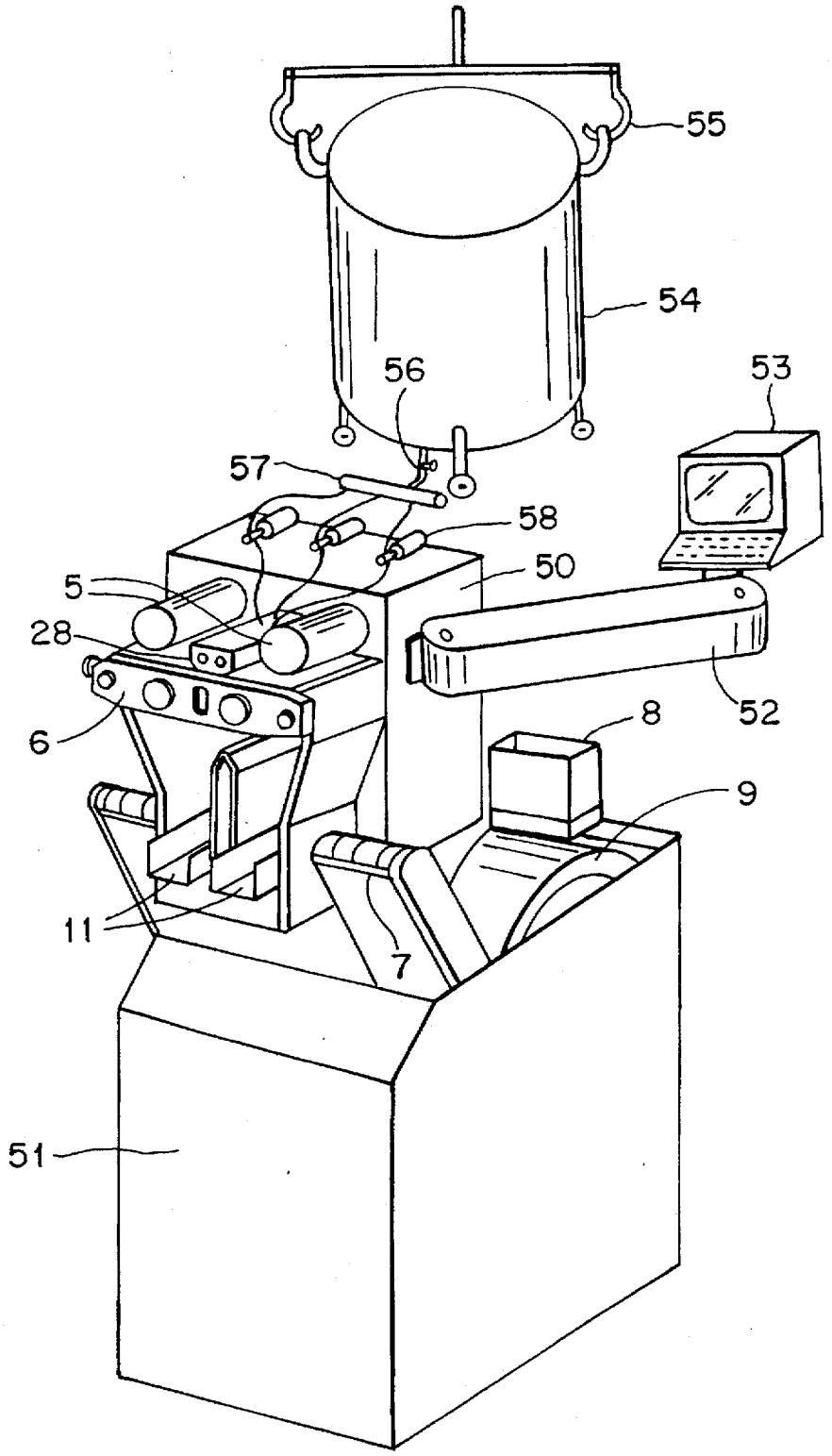
FIG. 6 is a perspective view of one preferred embodiment of the present invention.
Figure 7:
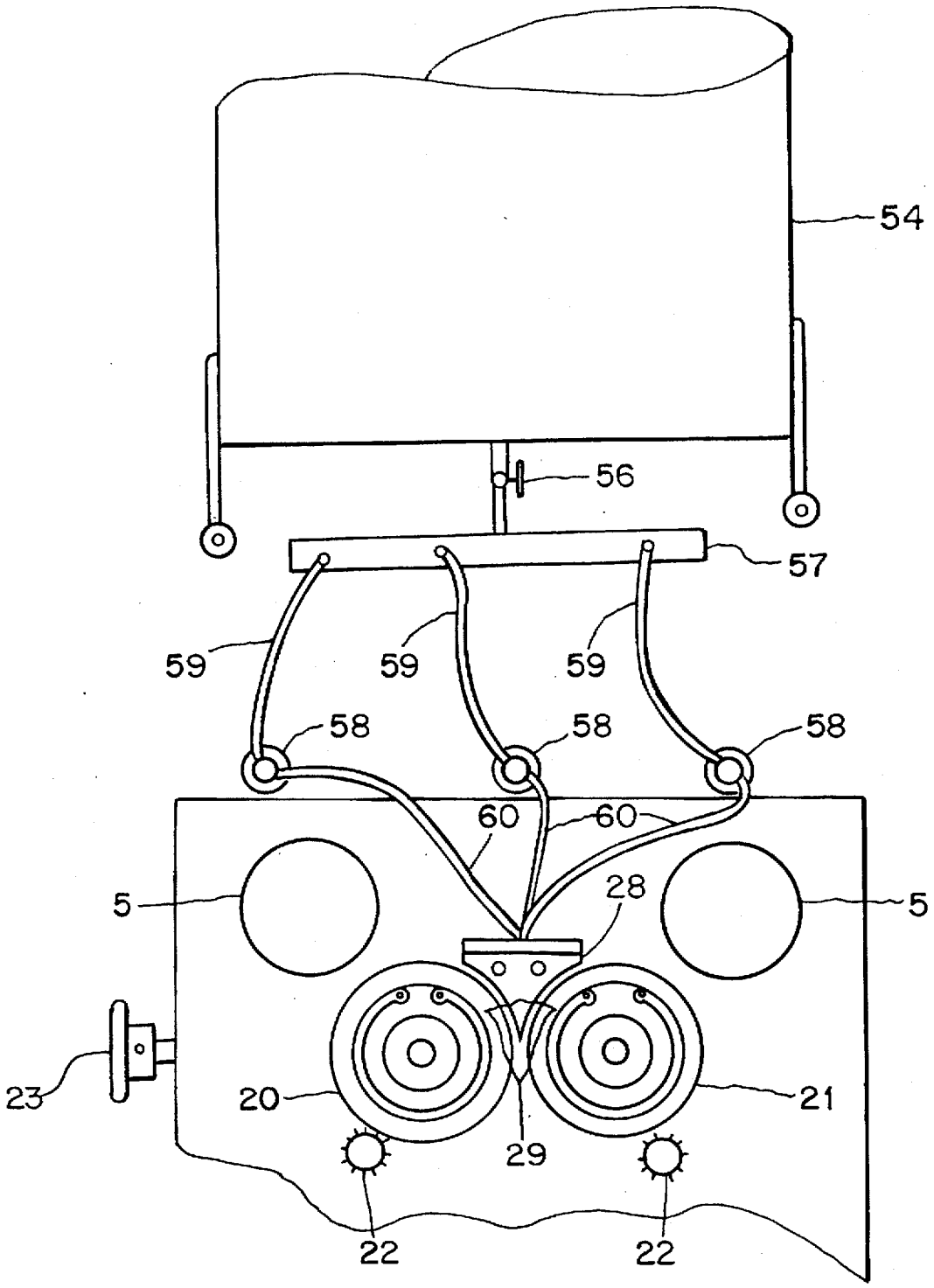
FIG. 7 is a front view, with sections removed, of one embodiment of the present invention.

FIGS. 6 and 7 show two views of one preferred embodiment 50 of the present invention. Alternate embodiments where the physical arrangement or placement of the components is different are certainly possible (and easy to accommodate) without deviating from the objectives of the present invention. For example, in an alternate embodiment, the plane of the casting drums 9 can be turned 90 degrees into alignment with the plane of the ribbon rollers 5 thereby eliminating a 90 degree ribbon twist in the preferred embodiment illustrated. In addition, it is also possible and easy to accommodate a redesign to the oil roller assembly 7, and utilize an oil filled tray to submerge the formed gelatin sheets in order to lubricate the gelatin ribbon. Notably missing from FIGS. 6 and 7 are the pump and pump housing, medicine return hose, shut-off valve, distribution plate, pump lifting handle. Also, the entire machine including the column 51 does not have a lubricant sight glass. A tank 54 is preferably suspended by a bracket 55 above the machine or rolled onto a mezzanine above the machine while the fill supply tank 54 could also be positioned on level with or below the capsule forming apparatus, or even at a remote location, it is most preferable to position the fill material tank above the main apparatus in order to minimize the likelihood that air bubbles will be introduced and travel into the pump supply lines. This fill material tank 54 is essentially substituted for hopper 2 of the prior art machine. This tank 54 holds the medicine or other fill material for the capsules. A supply valve 56 and intake manifold 57 supply the various pumps 58 through tubes 59. The manifold 57 can be fitted with a large number of self-sealing quick disconnects to accommodate as few as one or as many pumps as required. Lines 60 convey the medicine from the individual pumps 58 to the wedge 28. A distribution plate is unnecessary because a pump is provided for each injection site on the wedge 28. As shown in FIG. 7, both dies 20 and 21 have timing marks 29 which can be lined up with a line on the wedge 28. The dies are separately driven and have no die-to-die mechanical coupling as in the prior art machine. Most of the operator interfacing with the machine is two-way dialogue as presented by the operator interface terminal 53 through menu displays to the operator and keyboard inputs or other input methods such as direct screen point sensing from the operator. The illustrated operator interface terminal 53 may be attached to the machine via a swivel arm 52 or other means.

The previously utilized apparatus used a pump and pump housing manufactured from non-sanitary contact materials such as steel. Preferred embodiments of the present invention use a sanitary positive displacement valveless pump 58 as detailed in FIGS. 8–10. A complete pump module is available for OEM use. The illustrated pump consists of a motor 61, cylinder 62, piston 63, intake port 64, dispense port 65, and adjustment mechanism 66, adjustment gauge 67, and adjustment support pad 68. FIG. 8 depicts a single motor 61 driving two pistons 63. It is also feasible to install one piston and cylinder subassembly on a single motor. The piston 63 and cylinder 62 of the pumps are precision manufactured parts. Due to the pump design, all parts that will contact the fill material can be manufactured from various sanitary materials such as stainless steel, ceramic, and/or other FDA approved materials, resulting in significantly reduced potential for contamination. Due to the size and material of construction, the control portion of the pump, i.e. the portion of the piston and cylinder which contact the fill material, can be autoclaved for ultimate sanitary production. Pumping action is achieved by the rotation and reciprocation of piston in the cylinder.

FIG. 9 shows the exploded view and cut away of the pump during the intake of the fill material. The pump cylinder 62 has two ports—one intake 64 and one discharge 65. The piston 63 has a flat portion 69 which rotates to alternate between intake and discharge ports. Pumping action is achieved as follows. During the intake phase, the piston 63 is pulled backed while rotated clockwise to align the flat portion 69 with intake port 64. This action causes the fill material to be pulled into the cylinder cavity. FIG. 10 shows the exploded view of the pump during the discharge phase. The piston 63 is further turned 180 degrees to align the flat portion 69 of the piston to the discharge port 65. At this point the piston 63 is pushed into the cylinder 62 to push the fill material out through the discharge port 65. The cycle is repeated for the next set of cavities on the die. The piston stroke length determines the discharge volume which is adjusted by changing the relative angle between the cylinder 62 and motor 61 using rotation adjustment assembly consisting of parts 66, 67, and 68 depicted in FIG. 8. The adjustment assemblies of multiple pumps can be linked together to allow one step adjustment of some or all of the pumps. Additionally or alternatively, each pump can be adjusted individually for ultimate control.

Since pumps 58 have their own motor, the timing is achieved via electrical/electronic means, hence, eliminating all mechanical interlinks between pump and movement of dies. In addition, the pumps' discharge timing and pattern can be changed while encapsulation is in progress. The pumps' cycle is triggered via an electric/electronic signal and can be programmed to have a non-linear injection pattern or even multiple injections per die cavity. For example, a large capsule having a fill weight of 3,000 mg. can be injected in two equal discharges of 1,500 mg in the same cavity, resulting in the final weight of 3,000 mg. This method can provide better statistical control over the dispensed amount which reduces waste, weight variation, and down time due to weight variation, resulting in a better and more uniform product. The overall design and operation of the machine is simplified by use of this off-the-shelf valveless positive displacement pump system. The fill weight accuracy of the positive displacement valveless pump ranges between 0.1% and 0.5% compared to the pumping system of the old apparatus which could vary as much as 5%. The old system requires custom manufactured pumps each with specific size plungers to achieve the fill weight of certain range of capsules. The present invention can accommodate wide fill weight ranges.

Other pumps, with various accuracy capabilities, that use electric/electronic signals can also be substituted. For example, a small peristaltic pump may be substituted for the positive displacement valveless pump, however, such pumps may not be able to achieve the positive displacement valveless pump's accuracy.

Figure 11:
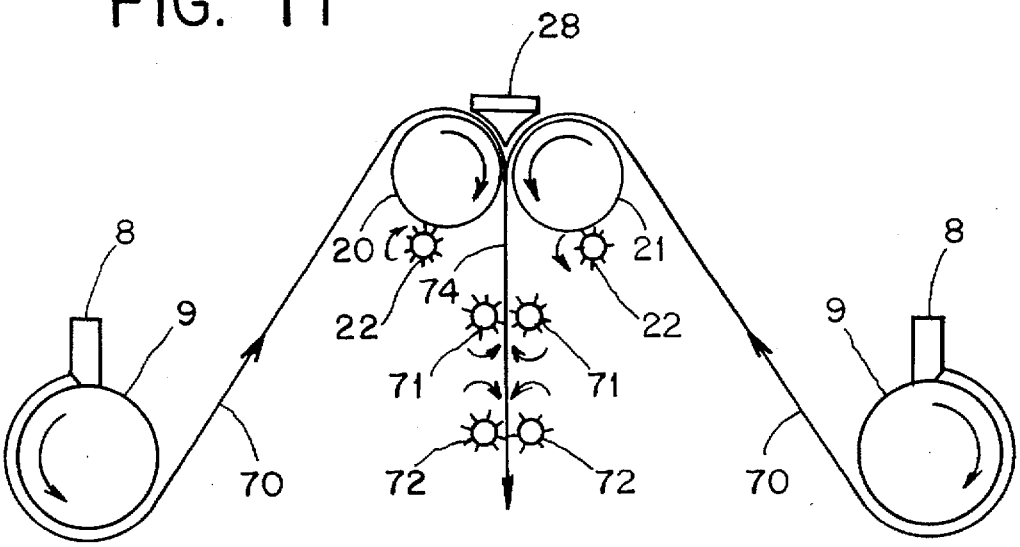
FIG. 11 illustrates the path of a gelatin ribbon of one embodiment of the present invention.

FIG. 11 is a simplified schematic diagram of the gelatin ribbon path from the liquid state in spreader boxes 8 over casting drums 9, around dies 20 and 21, merging at wedge 28 and emerging as ribbon 74. The stripper rollers 22 have soft elements that eject any capsules that may be stuck in dies 20 and 21. Further along are a pair of flipper rollers 71 that dislodge any capsules that may remain stuck in the merged ribbon 74. Finally, a pair of mangle rollers 72 are used to stretch and guide the merged ribbon 74 by an optimal amount which will vary by product.

Figure 12A:
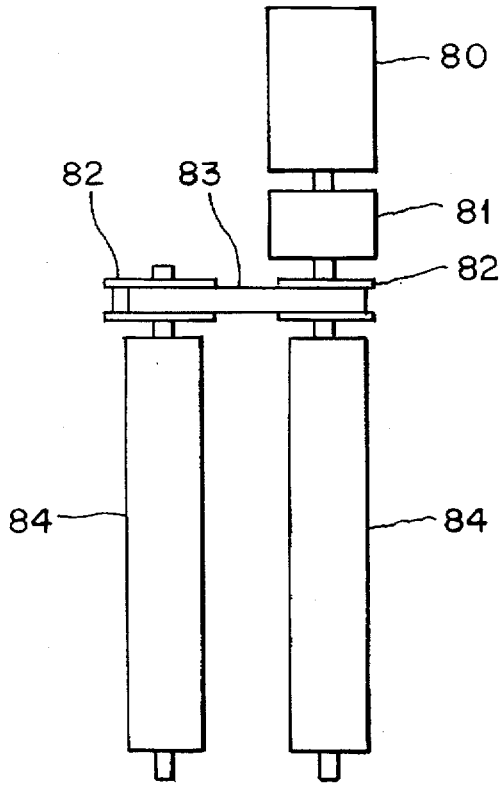
FIGS. 12A and 12B are top and side views respectively of a roller drive assembly of one embodiment of the present invention.
Figure 12B:
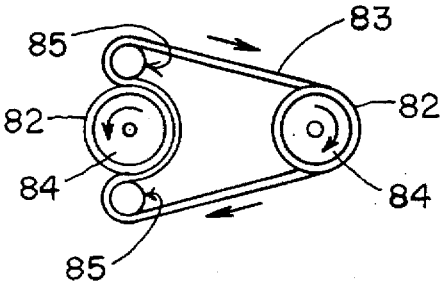

Each of these roller pairs 84 is driven by its own drive consisting of a motor 80, optional speed reducing gearbox 81, and can be interlinked in various ways including using a double sided timing belt 83 which couples the two rollers in a synchronous fashion via grooved timing belt pulley 82 and idlers 85 as shown in FIG. 12. The timing belt coupling can be substituted by spur gears which have solid lubricants dispersed in their tooth material matrix (no additional lubricant required). The motor-drive mechanism is installed behind the upper housing plate, hence, eliminating any potential for contamination. It should be noted that it is possible and simple to use two synchronized individual drives for any set of rollers discussed above.

Figure 17:
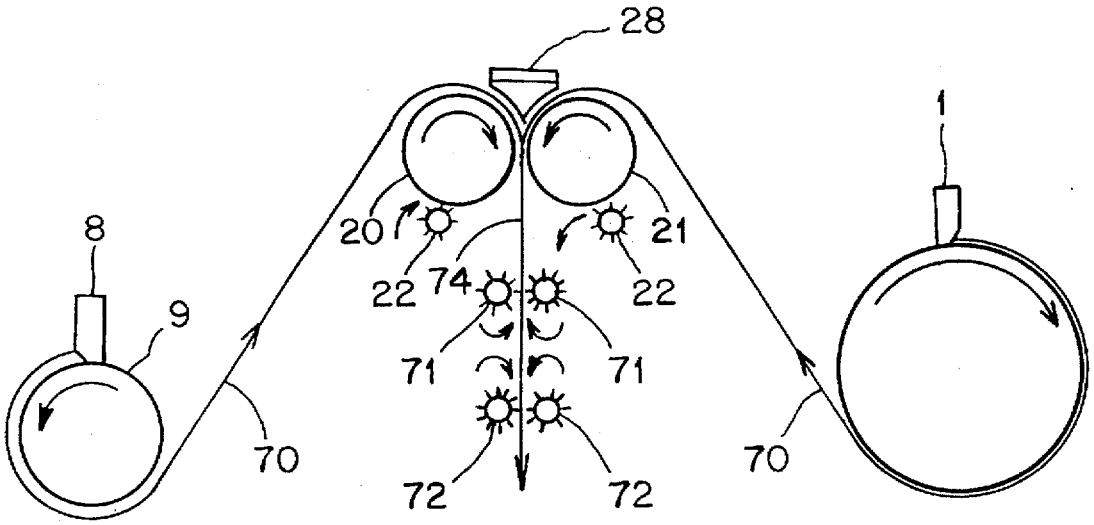
FIG. 17 illustrates two different gelatin paths of a single embodiment of the present invention.

While the embodiment illustrated in FIG. 11 comprises drums having substantially identical diameters, it is also within the scope of the present invention to utilize drums having different diameters in the manner shown in FIG. 17. Furthermore, it is within the scope of the present invention to have one continuously formed sheet treated differently from the other sheet in order to satisfy process requirements. This may be particularly desirable when the sheets are formed of different materials. For example, it may be desirable to subject one sheet to more extensive cooling, drying, setting time, or treatment with different conditions than the other sheet.

Figure 13:
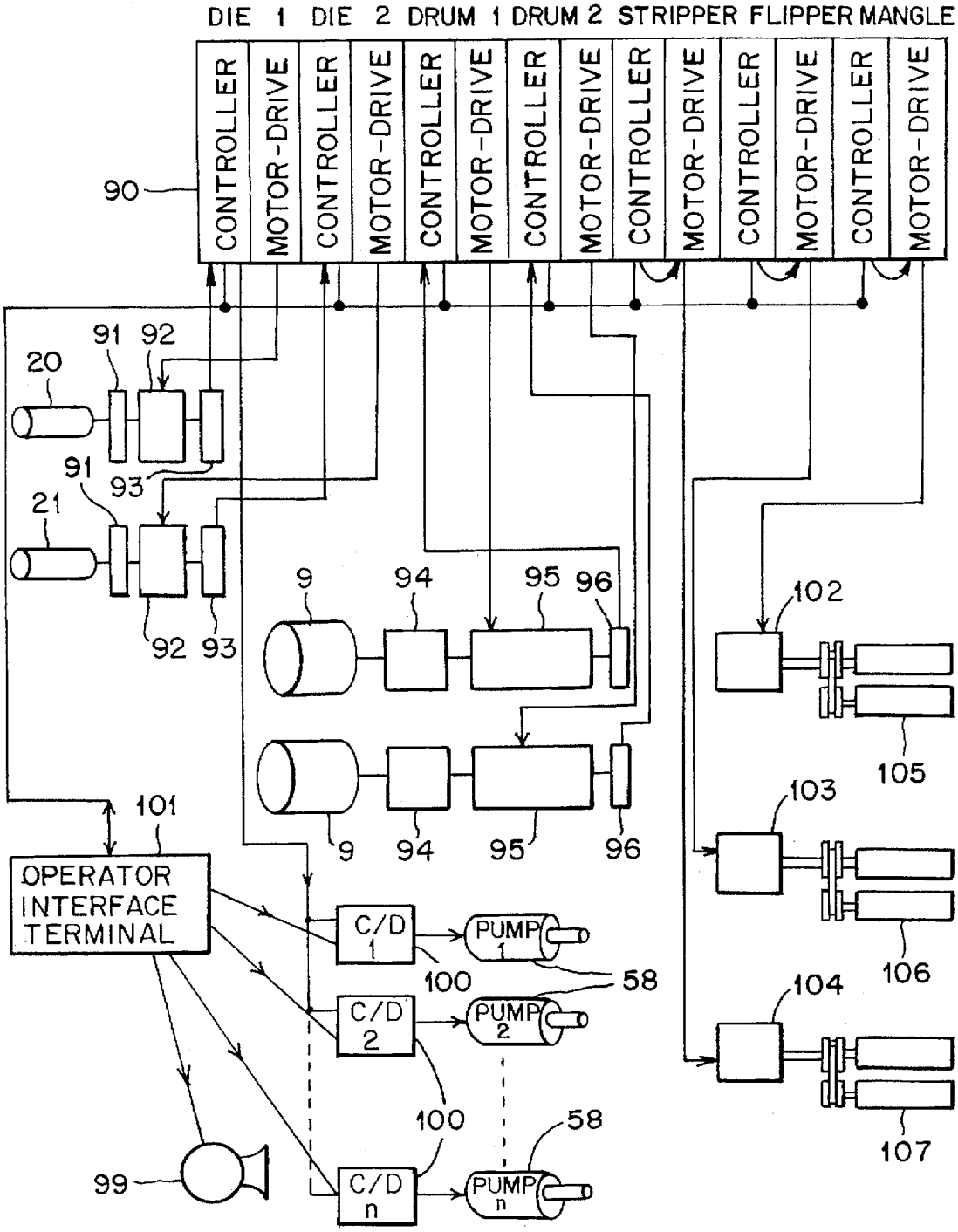
FIG. 13 is an illustrative block diagram of one embodiment of the present invention.

FIG. 13 is a system block diagram on one preferred embodiment of the present invention. The controller/motor-drive rack 90 directly controls the two dies 20 and 21, the drums 9, the stripper rollers 107, the flipper rollers 106, and the mangle rollers 105. The motor-drive is an electronic power amplifier that delivers the power to operate the motor in response to control signals. Modular multi-axis controller/motor-drive and motors are available from multiple suppliers. This rack 90 also indirectly controls the starting signal of the pumps 58. The existing variable-speed drives (usually referred to as drive) offer various degrees of accuracy. Naturally, the drive with a higher accuracy has a higher cost. Since the quality of capsules is directly related to the precise speed and position control of the dies 20 and 21, a highly accurate drive (controller/motor-drive/motor) is desired for driving the dies. The preferred control method in this case is feedback control, however, it is possible to utilize drives which use open control systems and do not require a feedback device, and still maintain acceptable accuracy.

The purpose of the gear reducer 91, is to reduce the motor speed and simultaneously increase output torque. It is preferred that the gear reducer has zero or near zero backlash. Another alternative is to use high torque, precision motors for motor 92. This motor, can run at low speed, and therefore, eliminate the need for gear reducer 91. In feedback control, the motor should be fitted with some kind of a feedback device 93. The controller will have the capability of position control which can establish a home position for dies 20 and 21 and also control synchronization between the two dies 20 and 21. Any adjustment in the relative position of either die can easily be accomplished by the operator with electrical/electronic commands. FIG. 13 also shows that the drums 9, have a drive mechanism similar to dies 20 and 21. The drum controllers/motor-drives are driving motors 95 with feedback device 96. The motors 95 drive the drums 9 through optional gear reducers 94. However, drive mechanism for drums 9 do not need as high an accuracy as the dies. The gear reducer 94 can also tolerate some backlash. The drives for drums 9 do not require any absolute position control, speed control will be adequate. The separate control of dies 20 and 21 and drums 9 means that a variety of die and drum sizes can be utilized on the same machine, including different drum sizes on right and left side simultaneously. Process requirements can be fine tuned during run time by adjusting the speed of individual drive(s).

Since the two dies 20 and 21 most preferably have different drives, the torque applied by each drive can be easily monitored and compared with charts of historical data. Any out of range torque value can be immediately detected by controller and operator interface terminal 101 and alarm 99 be activated. Alarm 99 can also be activated due to other process variables tending towards or being out of control.

The controller for one of the dies provides the various start signals for the pump control/motor-drive (C/D) 100 by reading the output of the feedback device 93 and generating and sending start signals to the appropriate count locations at the appropriate intervals as set up by operator interface terminal 101 at set up time. This assures excellent synchronization between the pump dispensing time and die cavity positions to prevent "leakers" or "light fill" products. The pump control/motor-drive 100 is open control, but other control methods such as feedback control can also be used.

The stripper 107, flipper 106 and mangle 105 rollers are respectively driven by variable-speed drives 102, 103 and 104, respectively, with optional gear reducers. These drives do not require high accuracy for either speed or position control and many types of drive with variable speed capability will work satisfactorily. The separate control of these drives significantly reduces machine maintenance and insures more effective operation. The separately adjustable mangle rollers 105 allow better removal of capsules by stretching gelatin ribbon 74 to an optimal tension which will vary by product.

Figure 14:
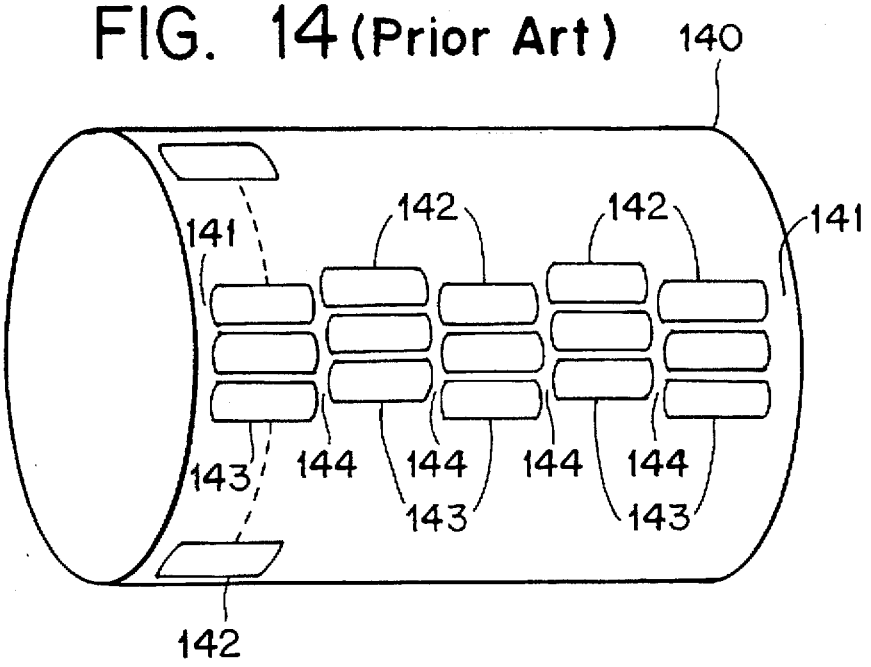
FIG. 14 (Prior Art)
FIG. 14 is a perspective view of a die of the prior art illustrating the cavity layout.

FIG. 14 is intended to illustrate a typical die 140 used on the prior art. The old art die 140 has identical size cavities 143 placed on identically spaced columns 142 around the die's circumference. The longitudinal spacing (indicated by numerals 144) between the cavities 143 is a function of the die's 140 overall length, the cavities 143 overall length, and the leading and trailing spaces 141. For example, if a die that is 6" long is being designed for a cavity that is 1.1" long and 0.3" wide with cavities positioned longitudinally, the old machines would allow only 5 cavities over the length of the die. The old machine's die design is limited since the pump timing is mechanically tied to the dies via an elaborate mechanical system including the timing gear.

Figure 15:
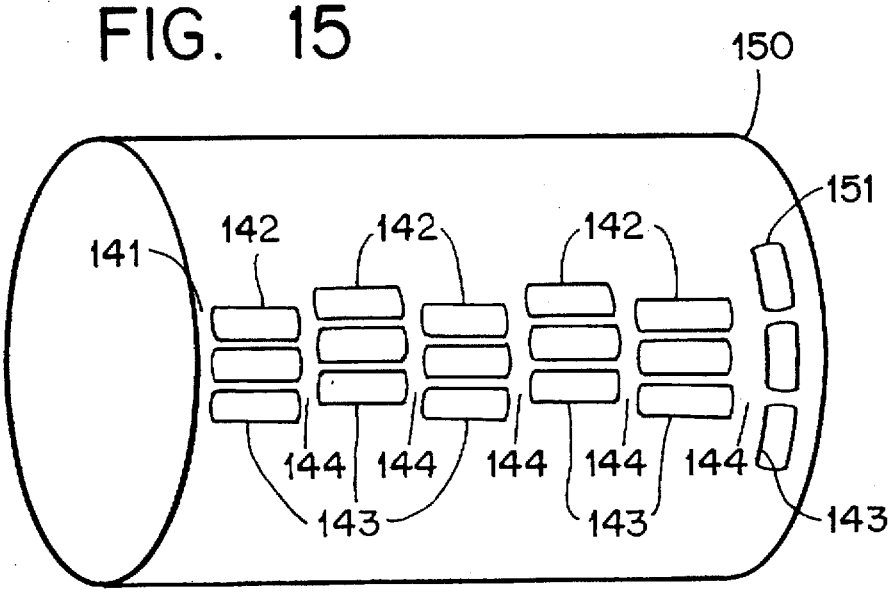
FIG. 15 is a perspective view of a die of the present invention illustrating a cavity layout of the present invention.

Due to the independent drive mechanism and electrical/electronic control of the pump's timing, the die cavities of the present invention can have various sizes, orientations, and/or shapes of the same die. Since each die column is filled using a single positive displacement valveless pump, each column can ultimately, have a different size and fill weight capsule with different cavity timing requirements. This technology opens new possibilities to increase productivity. It is important to discuss two of these benefits. The die productivity is based on the number of cavities that can be fitted on the die surface and the die revolutions per minute. The pumping technology of the present invention, in some cases, allows more cavities to be incorporated into the same space. Using the example discussed above, i.e. die is 6" long and is being designed for a cavity that is 1.1" long and 0.3" wide. Cavities being positioned longitudinally, the old machine would allow only 5 cavities over the length of the die. FIG. 15 shows a possible new die 150 usable on the present invention. Since the present invention can have different timing positions, the die of the present invention can have five columns 142 of cavities 143 placed longitudinally plus a sixth column 151 of cavities which is oriented 90 degrees to fit on the die. This is accomplished by reducing spaces 141 and 144 on the old die to turn the wasted area to productive capsule making column(s). This will allow additional cavities 143 to be placed around the die 150, hence, increasing the die's productivity and reducing wasted gelatin. This is only possible due to the independent activation of the fill pumps.

Figure 16:
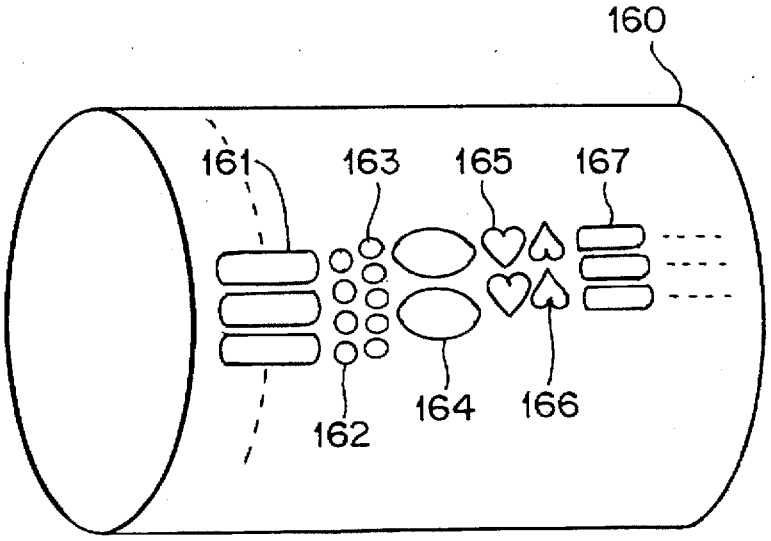
FIG. 16 is a perspective view of a die illustrating cavities of different configurations of the present invention.

The present invention also makes it possible to produce different products on the same die simultaneously. This is possible by placing different size and/or shape cavities on each column of the die. FIG. 16 shows a possible die 160 having cavities of different "configurations" which is used herein to indicate that at least two cavities on a die have different sizes, orientations and/or shapes. Column 161 is a typical oblong capsule, columns 162 and 163 are small round capsules, column 164 is a typical oval capsule, columns 165 and 166 are heart shaped cosmetic capsules, column 167 is another oblong capsule which is a different size from capsules in column 161. The remaining space on the die can be used for any other shape or size capsule. The example shown in FIG. 16 is an extreme case used to demonstrate the capability of this feature of the present invention, however, having two different size/shape capsules on the same die can have frequent applications. This feature creates an opportunity to produce different shaped capsules with identical or different fill material(s) and weight(s). Independent pumps can be connected to different fill tanks to measure and dispense different fill materials into the injection site of different columns on the die roll 160. This enables different products to be produced simultaneously. Using this approach, multiple production runs can be incorporated into a single run to eliminate multiple machine set-ups. It will be appreciated that the new various embodiments of the present invention can use any die including old dies. It will also be appreciated that it is not necessary that the cavities be offset or different. It is thus within the scope of the present invention to provide identical cavities which are aligned in rows and/or columns.

The differences in the two timing procedures required at setup for the prior art vs. the machines of this invention are noteworthy. The die-to-die timing process aligns the co-acting dies together. In the prior art machine, one must undo three bolts at the rear of the machine and turn an adjusting bolt to rotate the right die only until the two dies are timed or synchronized; this process takes about 15 minutes. In the new system, the die timing is a software function that can be verified or fine tuned from the front of the machine by use of the control switches in less than two minutes.

A second timing procedure involves injection of the fill material to the die, in other words timing for die-to-wedge-to-pump case-to-pump. An interactive procedure requiring about 20 minutes per iteration is required by the prior art machine. It is a complex procedure involving, casting and threading the appropriate thickness gelatin ribbon, then stopping the machine, jogging and aligning the dies timing marks 29 with the timing mark on wedge 28, raising the pump and pump housing, loosening bolts, manually turning the pump drive shaft until the pump is in the injection point, changing or adjusting the timing gear, retightening the bolts, starting the machine and producing capsules to check the results. Furthermore, if the timing is slightly off, the machine must be turned off and the timing process repeated. Since the pump case is the power transmission link between the machine (dies) and pump, the pump must be timed with the pump case prior to performing the procedure described above. The same timing is an automated process on the machines of the present invention involving pre-programmed offset angles for a specific pair of dies to a specific wedge and the preset gelatin ribbon thickness. Under a manual condition, the procedure may be accomplished in about 5 minutes using interactive displays. In addition, the present invention allows fine tuning of the timing during the machine's operation, hence, eliminating excessive loss of production time. Since the procedures are directed via interactive displays and the process is monitored via established electronics, operator training requirements are reduced. Simultaneously, operator utilization is increased by allowing the electronics to monitor the process and to signal the operator to make adjustments as needed. The same electronics can be programmed to stop production, if the operator does not respond in a preset time.

The machines of the present invention can do things that were not possible with the prior art. Run time adjustment of timing relationships is one entire category of functions. The following are other examples. In prior art machines, only the start of the pump dispensing cycle was adjustable. In this invention, the start, fill time and end time are all adjustable. In fact, with the proper drive, an arbitrary non-linear fill pattern can be programmed for total control. For example, during the fill of a single capsule, the dispensing rate of the pump can start slowly, increase to a very quick dispense rate and then taper off gradually before stopping. Alternatively, a plurality of very rapid discharges may be desirable. As stated above, the present invention provides optimum flexibility wherein the dispense functions between different columns, or even in the same column, can be programmed according to specific needs.

Figure 1C:
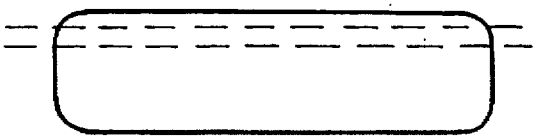
FIGS. 1(C)–1(E) illustrate areas of different shaped capsules which would typically tend to have the highest likelihood of seam weakness.
Figure 1D:
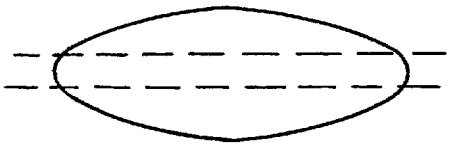
Figure 1E:
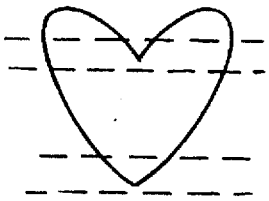

The capsule seam line or seam thickness is another factor in the physical quality of the product. Seam thickness is a function of several factors including seal time. In the prior art machines, seal time is equal at all points of the die and is a direct function of the machine speed. For example, a die speed of 2 rpm provides a seal time that is twice as long as a die speed of 4 rpm. By being able to control the die speed at all points of its rotation, a variable idle time or slower speed can be programmed every "X" degrees to provide for a stronger seam in that position. By independently modulating the movement of the dies in this manner, a particular seal time can be programmed practically irrespective of the average die speed. This technology provides a powerful tool and a potential solution to special problems without significantly reducing the machine's productivity. FIG. 1C, 1D and 1E generally illustrate regions of differently shaped cavities where seams would typically have a tendency to be weaker. The present invention advantageously permits a die having one or more of the shapes to rotate at a slower rate when sealing these regions of a capsule in order to provide a better seam.

Due to the independent control of the shafts driving the casting drums, it is possible to have different size casting drums on the same machine and use the die speed to drive the drums independently. This aspect is important when two different gelatin formulas are used to create one capsule. Different gelatin formulas may require different storage and pre-casting temperature and/or aging which will result in different quality gelatin sheets immediately prior to the encapsulation point. The present invention allows simultaneous use of different size drums to allow control over certain gelatin characteristics. Use of a larger drum on one side of the machine will allow changes to only one side of the capsule. As an example, this will be an important tool when producing a "two-tone" capsule (a capsule produced from two different colors, hence using two different gelatin formulas). As stated above, it is also within the scope of the present invention to provide different paths for identical or different sheets in order to provide different setting conditions to the sheets.

In terms of diagnostic capability, die torque monitoring through monitoring of the signals delivered by the die drives, can trigger alarm conditions or even be programmed to cause system shutdown. The same data plus other variables can be tabulated to track the performance of the machine during production of an FDA regulated product to document that the process was in control during the production run. This data can also be used in conjunction with expert system software to suggest preventative maintenance requirements as well as remote trouble shooting in case of a failure. Software can be used to analyze product quality as a function of a parameter setting, runtime adjustment, and various inputs to adjust initial parameters and/or modify settings during runs to optimize output quality. The system can be programmed to provide better results utilizing its accumulated databases of run statistics. These capabilities are only possible in a system that is designed with electronic and independent motor-drive controls.

It must be noted that the word "capsule" in the new invention refers to all encapsulated products including soft gelatin capsule. In addition, other material(s) may be substituted for gelatin including non-animal or synthetic material(s). As used herein, the term "ingestible" is used to indicate fill material is released in conditions simulating human digestion system or water.

What is claimed:

1. An apparatus for forming capsules comprising:

means for supplying at least one flowable mass which is formable into a sheet configuration;

means for forming two sheets from said flowable mass, said sheet forming means comprising a plurality of rotatable drums;

means for forming filled capsules with said sheets;

means for transferring said sheets from said sheet forming means to said capsule forming means;

said capsule forming means comprising:

a plurality of movable dies cooperatively forming an encapsulation region which receives said sheets, at least one of said dies comprising a plurality of spaced cavities;

means for dispensing a filler substance to at least one portion of one of said sheets prior to said portion exiting said encapsulation region where said filler substance is encapsulated between portions of said sheets;

wherein said dies are movable independent of said dispensing means.

2. An apparatus for forming capsules according to claim 1 wherein said dies are movable independently from said drums.

3. An apparatus for forming capsules according to claim 1 wherein said flowable mass is an ingestible material.

4. An apparatus for forming capsules according to claim 1 wherein said dispensing means comprises at least one independently operable pump.

5. An apparatus for forming capsules according to claim 4 further comprising means for varying the rate of dispensing said filler substance from at least one of said pumps.

6. An apparatus for forming capsules according to claim 1 wherein said dispensing means comprises a plurality of independently operable pumps.

7. An apparatus for forming capsules according to claim 6 further comprising means for varying the rate of dispensing said filler substance which can independently vary the dispense rate for a plurality of said pumps.

8. An apparatus for forming capsules according to claim 4 wherein said pump can vary the rate of dispensing filler substance during the formation of a single capsule.

9. An apparatus for forming capsules according to claim 1 wherein the speed of said dies can be varied during the formation of a single capsule.

10. An apparatus for forming capsules according to claim 1 wherein each of said drums is driven by an independently controlled drum motor.

11. An apparatus for forming capsules according to claim 1 wherein each of said dies is driven by an independently controlled die motor.

12. An apparatus for forming capsules according to claim 11 further comprising means for measuring the power consumption of at least one of said die motors.

13. An apparatus for forming capsules according to claim 12 further comprising means for indicating a change in the power consumption of at least one of said die motors.

14. An apparatus for forming capsules according to claim 1 further comprising means for stripping capsules from cavities of said dies.

15. An apparatus for forming capsules according to claim 14 wherein said stripping means is driven by at least one motor which is independent of said die motors.

16. An apparatus for forming capsules according to claim 1 further comprising means for dislodging capsules from sheet material exiting said dies.

17. An apparatus for forming capsules according to claim 16 wherein said dislodging means is driven by at least one motor which is independent of said die motors.

18. An apparatus for forming capsules according to claim 1 further comprising means for stretching sheet material exiting said dies.

19. An apparatus for forming capsules according to claim 18 wherein said stretching means is driven by at least one motor which is independent of said die motors.

20. An apparatus for forming capsules according to claim 1 wherein said dispensing means comprises at least one valveless, positive displacement pumps for dispensing said filler substance.

21. An apparatus for forming capsules according to claim 1 wherein said dispensing means comprises a plurality of valveless, positive displacement pumps.

22. An apparatus for forming capsules according to claim 20 wherein said pump comprises a control portion comprising a material selected from the group consisting of ceramic and stainless steel, and plastic.

23. An apparatus for forming capsules according to claim 20 wherein the actuation of said pumps is controlled by electric/electronic signals.

24. An apparatus for forming capsules according to claim 1 further comprising means for independently controlling said rotatable drums, said rotatable dies and said dispensing means.

25. An apparatus for forming capsules according to claim 1 wherein said dies are relatively independently movable while said dies are rotating.

26. An apparatus for forming capsules according to claim 1 wherein at least two of said cavities comprise different configurations.

27. An apparatus for forming capsules according to claim 1 wherein said drums have different diameters.

28. An apparatus for forming capsules comprising:

means for supplying at least one flowable mass which is formable into a sheet configuration;

means for forming two sheets from said flowable mass, said sheet forming means comprising a plurality of rotatable drums;

means for forming filled capsules with said sheets;

means for transferring said sheets from said sheet forming means to said capsule forming means;

said capsule forming means comprising:

a plurality of movable dies cooperatively forming an encapsulation region which receives said sheets, at least one of said dies comprising a plurality of spaced cavities;

means for dispensing a filler substance to at least one portion of one of said sheets prior to said portion exiting said encapsulation region where said filler substance is encapsulated between portions of said sheets, wherein said dispensing means can vary the rate of dispensing filler substance during the formation of a single capsule.

29. An apparatus for forming capsules according to claim 28 wherein said dies are independently movable.

30. An apparatus for forming capsules comprising:

means for supplying at least one flowable mass which is formable into a sheet configuration;

means for forming two sheets from said flowable mass, said sheet forming means comprising a plurality of rotatable drums, wherein each of said drums is driven by an independently controlled drum motor;

means for forming filled capsules with said sheets;

means for transferring said sheets from said sheet forming means to said capsule forming means;

said capsule forming means comprising:

a plurality of movable dies cooperatively forming an encapsulation region which receives said sheets, at least one of said dies comprising a plurality of spaced cavities;

means for dispensing a filler substance to at least one portion of one of said sheets prior to said portion exiting said encapsulation region where said filler substance is encapsulated between portions of said sheets.

31. An apparatus for forming capsules comprising:

means for supplying at least one flowable mass which is formable into a sheet configuration;

means for forming two sheets from said flowable mass, said sheet forming means comprising a plurality of rotatable drums;

means for forming filled capsules with said sheets;

means for transferring said sheets from said sheet forming means to said capsule forming means;

said capsule forming means comprising:

a plurality of movable dies cooperatively forming an encapsulation region which receives said sheets, at least one of said dies comprising a plurality of spaced cavities, wherein each of said dies is driven by an independently controlled die motor; and means for dispensing a filler substance to at least one portion of one of said sheets prior to said portion exiting said encapsulation region where said filler substance is encapsulated between portions of said sheets.

32. An apparatus for forming capsules comprising:

means for supplying at least one flowable mass which is formable into a sheet configuration;

means for forming two sheets from said flowable mass, said sheet forming means comprising a plurality of rotatable drums;

means for forming filled capsules with said sheets;

means for transferring said sheets from said sheet forming means to said capsule forming means;

said capsule forming means comprising:

a plurality of movable dies cooperatively forming an encapsulation region which receives said sheets, at least one of said dies comprising a plurality of spaced cavities;

means for dispensing a filler substance to at least one portion of one of said sheets prior to said portion exiting said encapsulation region where said filler substance is encapsulated between portions of said sheets, said dispensing means comprising a plurality of pumps, at least one of said pumps is operable independent of at least one other pump.

33. An apparatus for forming capsules according to claim 32 wherein actuation of at least one of said pumps is controlled by electric/electronic signals.

34. A method of forming capsules comprising the steps of:

providing means for supplying at least one flowable mass which is formable into a sheet configuration;

forming two sheets from said flowable mass;

providing means for forming filled capsules with said sheets comprising a plurality of movable dies cooperatively forming an encapsulating region which receives said sheets, driving said dies with two independent motors, at least one of said dies comprising a plurality of spaced cavities;

transferring said sheets from said sheet forming means to said capsule forming means;

dispensing a filler substance to at least one portion of one of said sheets prior to said portion exiting said encapsulation region where said filler substance is encapsulated between portions of said sheets.

35. An apparatus for forming capsules comprising:

means for supplying at least one flowable mass which is formable into a sheet configuration;

means for forming two sheets from said flowable mass, said sheet forming means comprising a plurality of rotatable drums;

means for forming filled capsules with said sheets;

means for transferring said sheets from said sheet forming means to said capsule forming means;

said capsule forming means comprising:

a plurality of movable dies cooperatively forming an encapsulation region which receives said sheets, at least one of said dies comprising a plurality of spaced cavities, wherein said dies are relatively independently movable while said dies are rotating; and means for dispensing a filler substance to at least one portion of one of said sheets prior to said portion exiting said encapsulation region where said filler substance is encapsulated between portions of said sheets.

36. An apparatus for forming capsules comprising:

means for supplying at least one flowable mass which is formable into a sheet configuration;

means for forming two sheets from said flowable mass, said sheet forming means comprising a plurality of rotatable drums;

means for forming filled capsules with said sheets;

means for transferring said sheets from said sheet forming means to said capsule forming means;

said capsule forming means comprising:

a plurality of movable dies cooperatively forming an encapsulation region which receives said sheets, at least one of said dies comprising a plurality of spaced cavities, wherein at least two of said cavities comprise different configurations; and means for dispensing a filler substance to at least one portion of one of said sheets prior to said portion exiting said encapsulation region where said filler substance is encapsulated between portions of said sheets.

37. A method of forming capsules comprising the steps of:

providing means for supplying at least one flowable mass which is formable into a sheet configuration;

forming two sheets from said flowable mass;

providing means for forming filled capsules with said sheets comprising a plurality of independently movable dies cooperatively forming an encapsule region which receives said sheets, at least one of said dies comprising a plurality of spaced cavities;

transferring said sheets from said sheet forming means to said capsule forming means;

adjusting the relative positioning of said movable dies while said sheets are moving between said dies; and dispensing a filler substance to at least one portion of one of said sheets prior to said portion exiting said encapsulation region where said filler substance is encapsulated between portions of said sheets.

38. A method of forming capsules according to claim 37 wherein said step of providing means for supplying at least one flowable mass comprises providing a flowable mass which is an ingestible material.

39. A method of forming capsules according to claim 37 wherein said step of dispensing a filler substance comprises dispensing at least one filler substance from at least one independently operable pump.

40. A method of forming capsules according to claim 37 wherein said step of dispensing a filler substance comprises dispensing at least one filler substance from a plurality of independently operable pumps.

41. A method of forming capsules according to claim 39 wherein said dispensing step comprises varying the rate of dispensing said filler substance from at least one of said pumps.

42. A method of forming capsules according to claim 41 wherein said dispensing step comprises independently varying the dispense rates of a plurality of said pumps.

43. A method of forming capsules according to claim 40 wherein said dispensing step comprises varying the rate of dispensing filler substance during the formation of a single capsule.

44. A method of forming capsules according to claim 37 further comprising the step of varying the speed of said dies during the formation of a single capsule.

45. A method of forming capsules according to claim 37 wherein said step of forming two sheets comprises depositing said flowable mass on two independently driven drums.

46. A method of forming capsules according to claim 37 further comprising the steps of providing means for driving said die and measuring the power consumption of said die driving means.

47. A method of forming capsules according to claim 46 further comprising the step of indicating a change in the power consumption of at least one of said die driving means.

48. A method of forming capsules according to claim 37 further comprising the step of stripping capsules from cavities of said dies.

49. A method of forming capsules according to claim 48 wherein said step of stripping capsules from cavities of said dies is performed with stripping means driven by at least one motor which is independent of said die driving means.

50. A method of forming capsules according to claim 37 further comprising the step of dislodging capsules from sheet material exiting said encapsulating region.

51. A method of forming capsules according to claim 50 wherein said step of dislodging capsules from said sheet material exiting said dies is performed with a dislodging means driven by a motor which is independent of said die driving means.

52. A method of forming capsules according to claim 37 further comprising the step of stretching said sheet material after said sheet material has passed between said dies.

53. A method of forming capsules according to claim 52 wherein said stretching step is performed with stretching means which is driven by a motor independent of said die driving means.

54. A method of forming capsules according to claim 37 wherein said step of providing capsule forming means comprises providing at least one die comprising cavities with different configurations.

55. A method of forming-capsules according to claim 37 wherein said step of forming two sheets comprises forming one sheet under a first set of conditions and forming a second sheet under a second set of conditions which are different from said first set of conditions.

56. A method of forming capsules comprising the steps of:

providing means for supplying at least one flowable mass which is formable into a sheet configuration;

forming two sheets from said flowable mass;

providing means for forming filled capsules with said sheets comprising a plurality of independently movable dies cooperatively forming an encapsulating region which receives said sheets, at least one of said dies comprising a plurality of spaced cavities;

transferring said sheets from said sheet forming means to said capsule forming means;

dynamically adjusting the speed of said movable dies at least twice during the formation of capsules in adjacent rows on said dies;

dispensing a filler substance to at least one portion of one of said sheets prior to said portion exiting said encapsulation region where said filler substance is encapsulated between portions of said sheets.

* * * * *